US006953192B2

(12) United States Patent
Jang

(10) Patent No.: US 6,953,192 B2
(45) Date of Patent: Oct. 11, 2005

(54) PAPER DELIVERY DEVICE IN PRINTER AND PRINTER USING THE SAME

(75) Inventor: Kyung-hwan Jang, Chungcheongnam-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 162 days.

(21) Appl. No.: 10/429,827

(22) Filed: May 6, 2003

(65) Prior Publication Data

US 2004/0026852 A1 Feb. 12, 2004

(30) Foreign Application Priority Data

Aug. 10, 2002 (KR) ..... 10-2002-0047355

(51) Int. Cl.[7] ..... B65H 31/04

(52) U.S. Cl. ..... 271/213; 271/303; 271/298; 271/292

(58) Field of Search ..... 271/298, 303, 271/213, 288, 292

(56) References Cited

U.S. PATENT DOCUMENTS

| | | | | | |
|---|---|---|---|---|---|
| 4,750,016 | A | * | 6/1988 | Kusumoto et al. | 399/405 |
| 4,945,390 | A | * | 7/1990 | Hasegawa et al. | 399/405 |
| 5,184,734 | A | * | 2/1993 | Yamaguchi | 209/657 |
| 5,553,528 | A | * | 9/1996 | Zoltner | 83/443 |

FOREIGN PATENT DOCUMENTS

| | | | | | |
|---|---|---|---|---|---|
| JP | 02066052 | A | * | 3/1990 | B65H/29/58 |
| JP | 02066053 | A | * | 3/1990 | B65H/29/60 |
| JP | 02147560 | A | * | 6/1990 | B65H/29/60 |
| JP | 03211161 | A | * | 9/1991 | B65H/31/24 |
| JP | 04023763 | A | * | 1/1992 | B65H/29/60 |
| JP | 04028658 | A | * | 1/1992 | B65H/29/60 |
| JP | 04 -101964 | | | 4/1992 | |
| JP | 04147760 | A | * | 5/1992 | B22D/18/06 |
| JP | 04308148 | A | * | 10/1992 | B65H/29/60 |

* cited by examiner

*Primary Examiner*—Donald P. Walsh
*Assistant Examiner*—Matthew J. Kohner
(74) *Attorney, Agent, or Firm*—Staas & Halsey LLP

(57) ABSTRACT

A paper delivery device in a printer selectively changes a stacking direction of printed and ejected paper and stacks paper. The device includes a first tray, and a second tray to pivot to a first position where paper is guided to the first tray and to a second position where the paper is stacked so that a side of an image of the paper is opposite to a side of an image of the first tray. The device also includes a first guide and a second guide to provide a side and the other side, respectively, of an ejecting route so that the paper is ejected to the first tray. The device includes a first roller and a second roller, each of the first and second rollers being installed in the first guide and second guide of the ejecting route. The device includes an ascending unit installed in the second tray to ascend the second roller so that the second roller is engaged with the first roller in the first position, and the second roller is placed under the second guide in the second position.

18 Claims, 4 Drawing Sheets

PAPER DELIVERY DEVICE IN PRINTER AND PRINTER USING THE SAME

CROSS-REFERENCE TO RELATED APPLICATION

This application claims the priority of Korean Patent Application No. 2002-47355, filed on Aug. 10, 2002, in the Korean Intellectual Property Office, the disclosure of which is incorporated herein by reference.

FIELD OF THE INVENTION

The present invention relates to a printer to print an image on paper, and more particularly, to a paper delivery device in a printer to allow paper to be ejected and stacked, and a printer using the same.

DESCRIPTION OF THE RELATED ART

In general, printers eject paper and stack the paper in a face-up or face-down state in which a side of an image of the paper faces upward or downward.

FIG. 1 is a diagram of a conventional printer in which the paper in a face-up state is stacked, and FIG. 2 is a diagram of a conventional printer in which the paper in a face-down state is stacked.

Referring to FIG. 1, while paper S, drawn out from a paper feeding cassette 10, is fed and transferred to a printing unit 20, an image is printed on a top side of the paper S. Next, the paper S is ejected by a pair of ejecting rollers 30 installed in an outlet of the printing unit 20. Then, the paper S in the face-up state is stacked in a tray 40.

Referring to FIG. 2, the paper S, drawn out from a paper feeding cassette 10', is fed and transferred to a printing unit 20', and an image is printed on a top side of the paper S. Next, the paper S is ejected by three pairs of ejecting rollers 30', passes through an ejecting route 60, and is then stacked in a stacking unit 50. As shown in FIG. 2, a transfer direction of the paper S is changed from its original direction, and the paper S in the face-down state in which a side of the image faces downward, is stacked in the stacking unit 50.

As shown in FIG. 1, when the paper S in the face-up state is stacked, the side of the image of the ejected paper S faces upward, so that a user may see a printing state of the image. However, when several pieces of consecutive data are printed, the paper S is stacked in a reverse order, and the user has to arrange the paper S in a regular sequence.

Also, as shown in FIG. 2, when the paper S in the face-down state is stacked and several pieces of consecutive data are printed, the paper S is stacked in regular sequence. However, the side on which the image is shown on the ejected paper S, faces downward. Thus, while the paper S is ejected, the user cannot see a printing state of the image until the user manually flips the paper S over.

Accordingly, in order to solve the above problems, a paper delivery device in which a user may selectively stack paper in a face-up or face-down state, is provided.

SUMMARY OF THE INVENTION

Accordingly, it is an aspect of the present invention to provide a paper delivery device in a printer to selectively stack paper in a face-up or face-down state, and a printer using the same.

Additional aspects and advantages of the invention will be set forth in part in the description which follows and, in part, will be obvious from the description, or may be learned by practice of the invention.

The foregoing and/or other aspects of the present invention are achieved by providing a paper delivery apparatus in a printer to selectively change a stacking direction of printed and ejected paper, and to stack paper. The apparatus includes a first tray, and a second tray to pivot to a first position where paper is guided to the first tray, and to a second position where the paper is stacked so that a side of an image of the paper is opposite a side of an image of the paper stacked in the first tray. The apparatus also includes a first guide to provide a side of an ejecting route so that the paper is ejected to the first tray, a second guide installed in the second tray opposite to the first guide to provide the other side of the ejecting route when the second tray is placed in the first position. The apparatus includes a first roller installed in the first guide of the ejecting route, a second roller engaged with the first roller in the ejecting route to rotate and eject the paper to the first tray when the second tray is placed in the first position, and an ascending unit installed in the second tray to ascend the second roller so that the second roller is engaged with the first roller in the first position and the second roller is placed under the second guide in the second position.

The foregoing and/or other objects of the present invention are achieved by providing a printer including a printing unit to print an image on paper and a paper delivery device to selectively change a stacking direction of printed and ejected paper, and to stack paper. The paper delivery device includes a first tray, and a second tray to pivot to a first position where paper is guided to the first tray, and to a second position where the paper is stacked so that a side of an image of the paper is opposite a side of an image of the paper stacked in the first tray. The device also includes a first guide to provide a side of an ejecting route so that the paper is ejected to the first tray, a second guide installed in the second tray opposite to the first guide to provide the other side of the ejecting route when the second tray is placed in the first position. The device includes a first roller installed in the first guide of the ejecting route, a second roller which is engaged with the first roller in the ejecting route to rotate and eject the paper to the first tray when the second tray is placed in the first position, and an ascending unit installed in the second tray to ascend the second roller so that the second roller is engaged with the first roller in the first position and the second roller is placed under the second guide in the second position.

According to an aspect of the invention, the ascending unit includes a support lever to couple to a hinge of the second tray and to pivot on the hinge. The second roller is coupled to one end of the support lever to rotate the second roller. The ascending unit also includes an interference member to interfere with the other end of the support lever when the second tray is pivoted from the first position to the second position, and to pivot the support lever so that the second roller is engaged with the first roller. The ascending unit further includes a first elastic member to apply an elastic force to the support lever so that the support lever is pivoted in a direction in which the second roller is placed under the second guide.

According to the present invention, a user may selectively stack paper by pivoting a second tray to first and second positions so that a side of an image of ejected paper faces upward or downward. In addition, a second roller is ascended by an ascending unit so that defects of stacking paper may be prevented.

BRIEF DESCRIPTION OF THE DRAWINGS

The above and/or other aspects and advantages of the invention will become apparent and more appreciated from the following description of the preferred embodiments, taken in conjunction with the accompanying drawings of which.

DETAILED DESCRIPTION OF THE PREFERRED EMBODIMENTS

Figure 1:
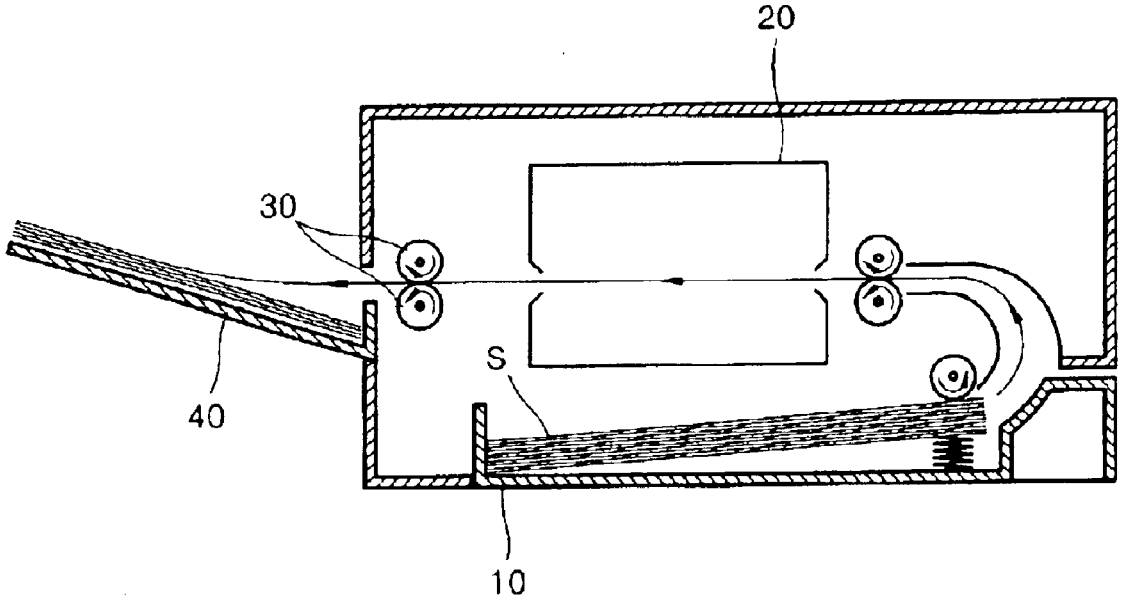
FIG. 1 (PRIOR ART)
FIG. 1 is a diagram of a conventional printer in which paper in a face-up state is stacked.
Figure 2:
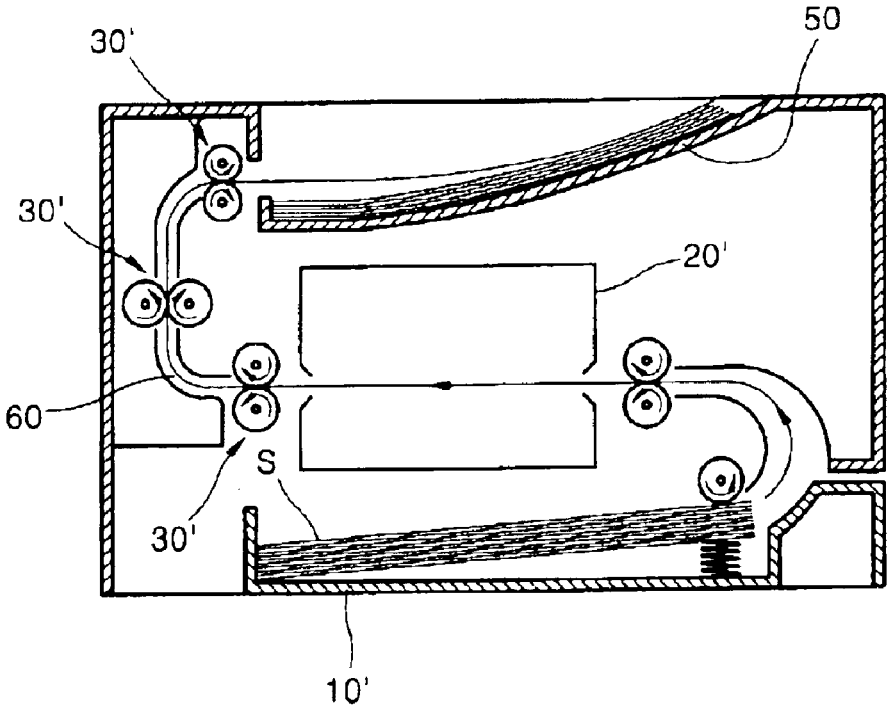
FIG. 2 (PRIOR ART)
FIG. 2 is a diagram of a conventional printer in which paper in a face-down state is stacked.

Reference will now be made in detail to the present preferred embodiments of the present invention, examples of which are illustrated in the accompanying drawings, wherein like reference numerals refer to like elements throughout.

Figure 3:
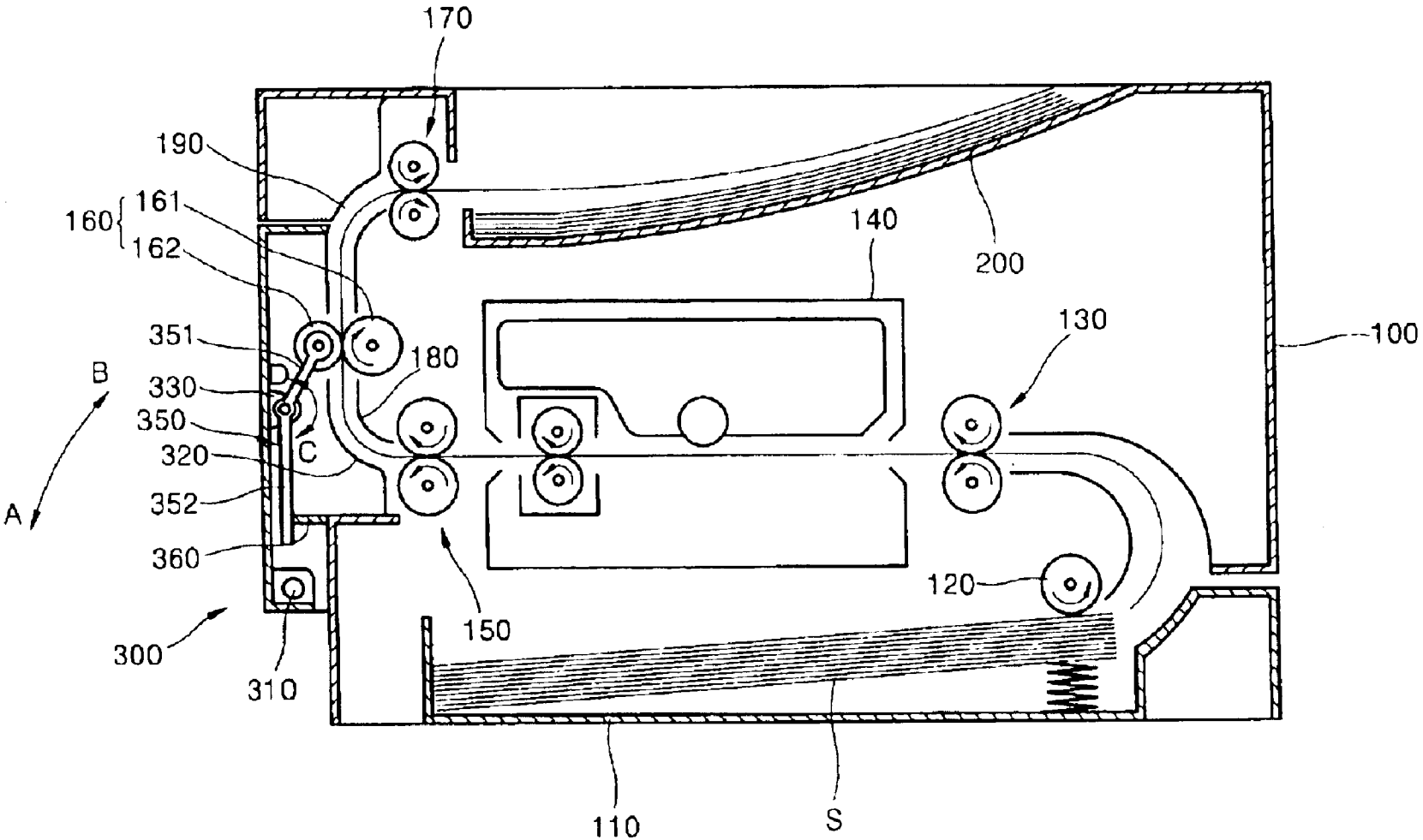
FIGS. 3 and 4 is a diagram of a printer in which paper is stacked in a first tray, and paper is stacked in a second tray, respectively, according to an embodiment of the present invention.
Figure 4:
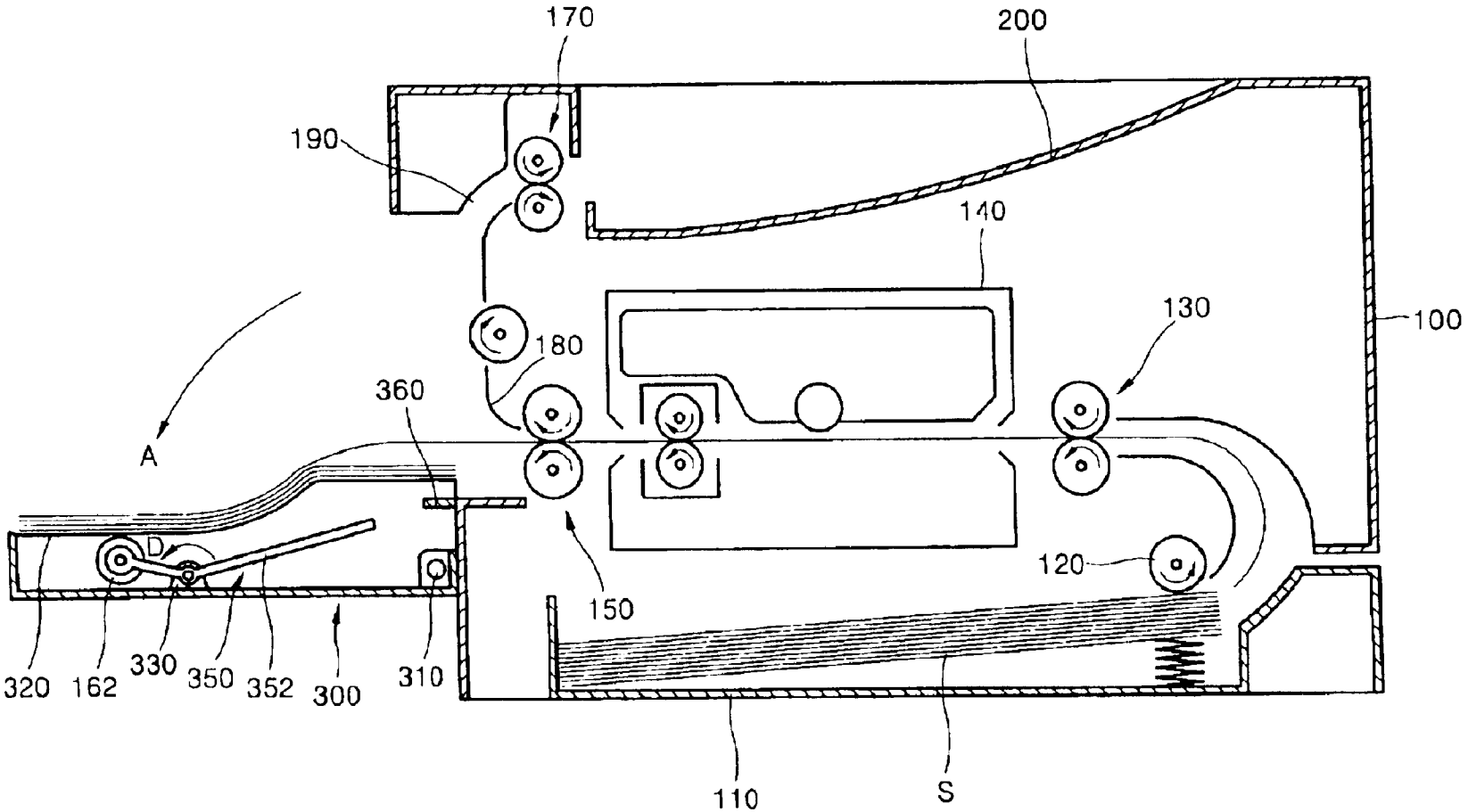

FIGS. 3 and 4 is a diagram of a printer in which paper is stacked in a first tray, and paper is stacked in a second tray, respectively, according to an embodiment of the present invention.

Referring to FIGS. 3 and 4, a paper feeding cassette 110 in which a paper S to print is stacked, is installed in a lower portion of a main body 100. A pickup roller 120 which draws out the paper S from the paper feeding cassette 110 to supply the paper S to a printing unit 140, is installed in an upper portion of the paper feeding cassette 110. A transfer roller 130 to transfer the paper S to a first ejecting roller 150, is installed between the pickup roller 120 and the printing unit 140.

The printing unit 140 forms an image on a top side of the paper S transferred by the transfer roller 130. The printing unit 140 may also form an image on a bottom side of the paper S. In the present embodiment, the printing unit 140 forms an image on the top side of the paper S.

The first ejecting roller 150, a second ejecting roller 160, and a third ejecting roller 170 are installed along a traveling direction of the paper S from an outlet of the printing unit 140 to a first tray 200. The paper S, after being guided pass the third ejecting roller 170, is stacked in the first tray 200. Each of the first ejecting roller 150 and the third ejecting roller 170 includes a pair of driving rollers and passive rollers which engage with each other and rotate. The second ejecting roller 160 includes a first roller 161 installed in the main body and a second roller 162 installed in a second tray 300. Preferably, the first roller 161 is a driving roller, and the second roller 162 is a passive roller. Also, the first roller 161 may be a passive roller, and the second roller 162 may be a driving roller.

The second tray 300 is installed in the main body 100 to be pivoted in directions A and B via a first hinge 310. A plurality of ribs 320 used as second guides to provide an ejecting route 190 from the first ejecting roller 150 to the third ejecting roller 170 together with a first guide 180 provided in the main body 100, are arranged in the second tray 300 in a widthwise direction of the paper S, as shown in FIG. 3.

An ascending unit to ascend the second roller 162 toward upper and lower surfaces of the ribs 320 according to a position of the second tray 300, includes a support lever 350 and an interference member 360 which are installed in the second tray 300 and the main body 100, respectively.

The support lever 350 is installed on a second hinge 330 of the second tray 300 to be pivoted in directions C and D. The second roller 162 is coupled to one end 351 of the support lever 350 to rotate, and the other end 352 of the support lever 350 interferes with the interference member 360 installed in the main body 100. The second hinge 330 is formed in a position so that the support lever 350 is pivoted in the direction D by its weight and by the weight of the second roller 162 when the second tray 300 is moved towards the A position as shown in FIG. 4.

If a plurality of second rollers 162 are placed between the ribs 320, preferably, a plurality of the support levers 350 and a plurality of the interference members 360 may be installed.

Hereinafter, an operation of a printer using the paper delivery device according to the present invention will be described with reference to FIGS. 3 and 4.

Referring to FIG. 3, the paper S, drawn out from the paper feeding cassette 110 by the pickup roller 120, is fed to the printing unit 140 by the transfer roller 130, and an image is printed on the top side of the paper S. The printed paper S is transferred by the first ejecting roller 150 and contacts a lower end of the rib 320, while a traveling direction of the paper S is changed from a horizontal direction to a vertical direction. If the first ejecting roller 150 continuously rotates, the paper S is ejected to the first tray 200 by the third ejecting roller 170 along the ejecting route 190 through the second ejecting roller 160. Here, the paper S in a face-down state in which a side of the image of the paper S faces downward, is stacked in the first tray 200.

In order to stack the paper S in a face-up state, as shown in FIG. 4, the second tray 300 is pivoted in a direction A on the first hinge 310. Then, the first guide 180 and the rib 320 are separated from each other such that the rib 320 does not provide the ejecting route 190 from the first ejecting roller 150 to the third ejecting roller 170. Thus, the paper S guided from the first ejecting roller 150 is directly ejected to the second tray 300. In this case, the paper S in the face-up state in which the side of the image of the paper S faces upward, is stacked in the second tray 300.

In this state, if the second roller 162 protrudes toward the rib 320 as shown in FIG. 3, defects in which a front end of the delivered paper S is caught in the second roller 162 and folded or the paper S is not uniformly stacked, may occur. In a worse case scenario, a paper jam may occur. However, according to the present invention, as shown in FIG. 4, when the second tray 300 is pivoted in the direction A, the other end 352 of the support lever 350 is escaped from interference with the interference member 360. Thus, the support lever 350 is pivoted by its weight and by the weight of the second roller 162 in the direction D on the second hinge 330 such that an outer surface of the second roller 162 is placed under the rib 320. Thus, the delivered paper S is not caught in the second roller 162 and is smoothly ejected along the rib 320.

In order to stack the paper S in the face-down state, if the second tray 300 is pivoted in the direction B as shown in FIG. 3, the rib 320 and the first guide 180 form the ejecting route 190 from the first ejecting roller 150 to the third ejecting roller 170. Also, when the second tray 300 is pivoted in the direction B, the other end 352 of the support lever 350 interferes with the interference member 360, and the support lever 350 is pivoted in the direction C such that the second roller 162 and the first roller 161 are engaged in the ejecting route 190. Thus, the paper S, guided from the printing unit 140 through the first ejecting roller 150, the second ejecting roller 160, and the third ejecting roller 170 is stacked in the face-down state in the first tray 200.

Figure 5:
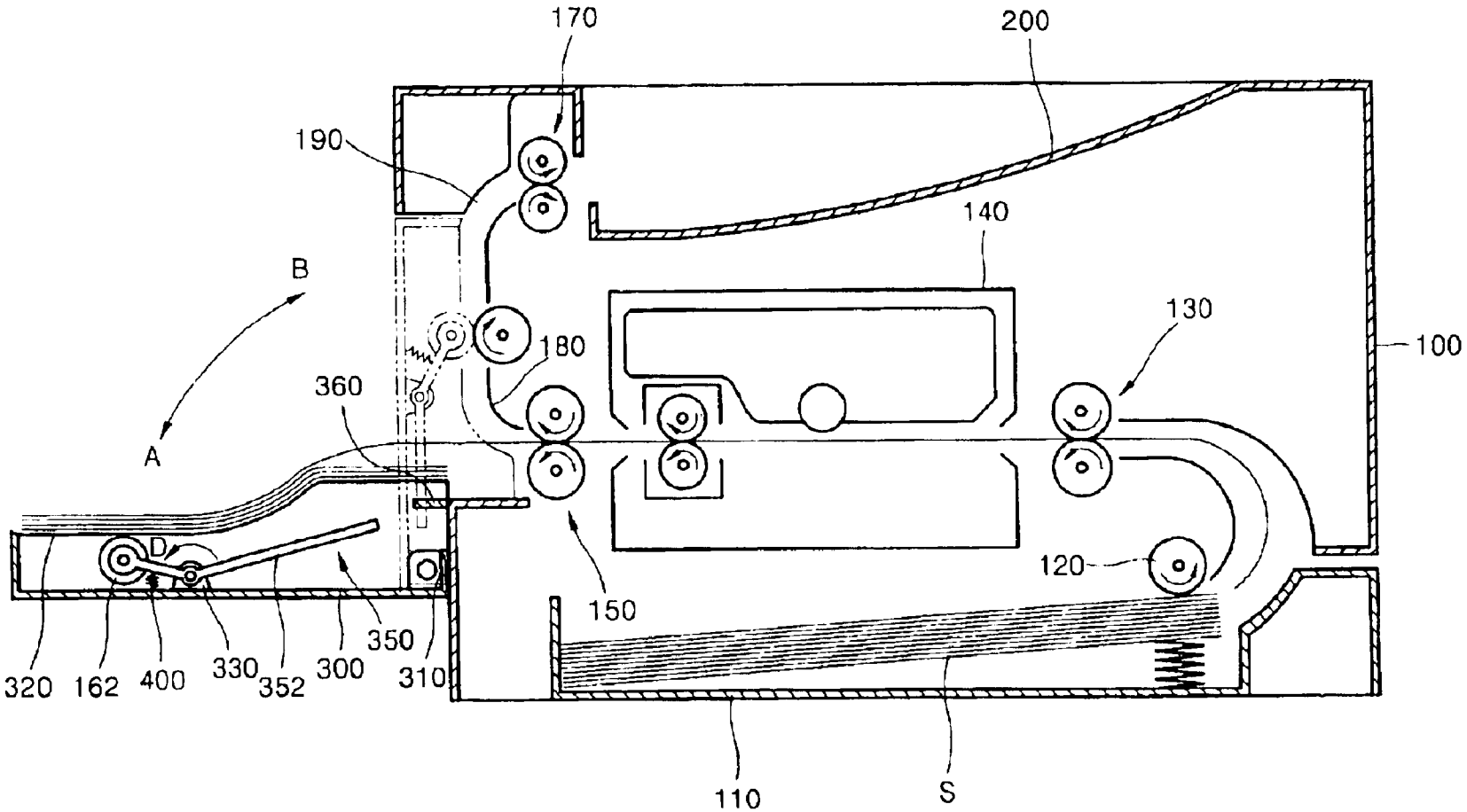
FIG. 5 is a diagram of the printer of FIG. 4 using a paper delivery device and a tension coil spring.

FIG. 5 is a diagram of the printer of FIG. 4 using a paper delivery device and a tension coil spring. The structure of FIG. 5 is the same as shown in FIG. 4 except that a tension coil spring 400 is further installed between the support lever 350 and the second tray 300. The tension coil spring 400 applies an elastic force to the support lever 350 in a direction in which the second roller 162 is separated from the first roller 161. The tension coil spring 400 is an example of a first elastic member which applies an elastic force to the support lever 350 so that the support lever 350 is pivoted in a direction in which the second roller 162 is placed under the rib 320, and thus, does not restrict the scope of the present invention. However, an elastic member in various shapes and formed of various materials instead of the tension coil spring 40, may be used as the first elastic member.

Also, although not shown in FIGS. 3 through 5, preferably, an elastic member is used as both the support lever 350 and the interference member 360, or either the support lever 350 or the interference member 360. In this case, preferably, an interference quantity between the other end 352 of the support lever 350 and the interference member 360 is slightly larger than an interference quantity required when the first roller 161 and the second roller 162 are engaged with each other as shown in FIG. 3. This is because after the first roller 161 and the second roller 162 are engaged with each other, the support lever 350 and/or the interference member 360 as an elastic member are/is elastically deformed, and an elastic force may be applied to the first roller 161 and the second roller 162.

In order to simplify a power connection structure, preferably, a power is connected only to the first roller 161 installed in the main body 100. Thus, the second roller 162 applies a predetermined pressure to the first roller 161 and contacts the first roller 161 so that the second roller 162 rotates together with the first roller 161.

Further, if both the support lever 350 and the interference member 360, or either the support lever 350 or the interference member 360 is formed of a material which may be elastically deformed, the interference quantity between the interference member 360 and the support lever 350 is properly set based on the elastic deformation quantity between the support lever 350 and the interference member 360. Also, when the second tray 300 is positioned as shown in FIG. 3, the second roller 162 rotates together with the first roller 161 even though a gear (not shown) is not connected to the first and second rollers 161 and 162.

In the above-mentioned embodiment, printed paper in a face-down state and in a face-up state is stacked in a first tray and a second tray, respectively. However, according to another embodiment of a printing unit, the printed paper in the face-down state and in the face-up state may be stacked in the second tray and in the first tray, respectively.

As described above, the paper delivery device according to the present invention and the printer using the same have the following advantages. First, the printed paper S in the face-up or face-down state may be stacked by simply pivoting a second tray. Second, a second roller may be ascended with respect to ribs from which the paper S is ejected such that the paper S is stably ejected to and stacked in a first tray and a second tray without defects of stacking the paper S or having paper jams. Third, both a support lever to ascend the second roller and an interference member, and either the support lever or the interference member is formed of a material which may be elastically deformed such that the second roller is rotated even though a power is not connected to the second roller by a gear.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A paper delivering apparatus in a printer to selectively change a stacking direction of printed and ejected paper, and to stack the paper, the apparatus comprising:

a first tray;

a second tray to pivot to a first position where the paper is guided to the first tray, and to pivot to a second position where the paper is stacked so that a side of an image of the paper is opposite a side of an image of the paper stacked in the first tray;

a first guide to provide a side of an ejecting route so that the paper is ejected to the first tray;

a second guide installed in the second tray opposite to the first guide to provide the other side of the ejecting route when the second tray is placed in the first position;

a first roller installed in the first guide of the ejecting route;

a second roller engaged with the first roller in the ejecting route to rotate and eject the paper to the first tray when the second tray is placed in the first position; and an ascending unit installed in the second tray to ascend the second roller so that the second roller is engaged with the first roller in the first position and the second roller is placed under the second guide in the second position.

2. The apparatus of claim 1, wherein the ascending unit comprises:

a support lever to couple to a hinge of the second tray and to pivot on the hinge, wherein the second roller is coupled to one end of the support lever to rotate; and an interference member to interfere with the other end of the support lever when the second tray is pivoted from the first position to the second position, and to pivot the support lever so that the second roller is engaged with the first roller.

3. The apparatus of claim 2, wherein the support lever is pivoted so that the second roller is placed under the second guide by a weight of the support lever and by a weight of the second roller when the second tray is placed in the second position.

4. The apparatus of claim 2, wherein the ascending unit further comprises:

an elastic member to apply an elastic force to the support lever so that the support lever is pivoted in a direction in which the second roller is placed under the second guide.

5. The apparatus of claim 2, wherein the interference member is an elastic body to apply an elastic force so that the interference member is deformed by an interference with the support lever, and the second roller is elastically engaged with the first roller.

6. The apparatus of claim 2, wherein the support lever is an elastic body to apply an elastic force so that the support lever is deformed by an interference with the interference member, and the second roller is elastically engaged with the first roller.

7. The apparatus of claim 1, wherein at least a portion of the second roller is placed above the second guide when the second roller is engaged with the first roller in the first position.

8. A printer having a printing unit to print an image on a paper, and a paper delivery device to selectively change a stacking direction of printed and ejected paper, and to stack the paper, the paper delivery device comprising:

a first tray;

a second tray to pivot to a first position where the paper is guided to the first tray, and to pivot to a second position where the paper is stacked so that a side of an image of the paper is opposite a side of an image of the paper stacked in the first tray;

a first guide installed in a main body of the printer to provide a side of an ejecting route so that the paper is ejected to the first tray;

a second guide installed in the second tray opposite to the first guide and to provide the other side of the ejecting route when the second tray is placed in the first position;

a first roller installed in the first guide of the ejecting route;

a second roller engaged with the first roller in the ejecting route to rotate and eject the paper to the first tray when the second tray is placed in the first position; and an ascending unit installed in the second tray to ascend the second roller so that the second roller is engaged with the first roller in the first position and the second roller is placed under the second guide in the second position.

9. The printer of claim 8, wherein the ascending unit comprises:

a support lever installed in the second tray to couple to a first hinge of the second tray and to pivot on the first hinge, wherein the second roller is coupled to one end of the support lever to rotate; and an interference member installed in the main body of the printer to interfere with the other end of the support lever when the second tray is pivoted from the first position to the second position, and to pivot the support lever so that the second roller is engaged with the first roller.

10. The printer of claim 9, wherein the support lever is pivoted so that the second roller is placed under the second guide by a weight of the support lever and by a weight of the second roller when the second tray is placed in the second position.

11. The printer of claim 9, wherein the ascending unit further comprises:

an elastic member to apply an elastic force to the support lever so that the support lever is pivoted in a direction in which the second roller is placed under the second guide.

12. The printer of claim 9, wherein the interference member is an elastic body to apply an elastic force so that the interference member is deformed by an interference with the support lever, and the second roller is elastically engaged with the first roller.

13. The printer of claim 9, wherein the support lever is an elastic body to apply an elastic force so that the support lever is deformed by an interference with the interference member, and the second roller is elastically engaged with the first roller.

14. The printer of claim 8, further comprising:

a second hinge provided in the printer to allow the second tray to pivot to the first position and the second position.

15. The printer of claim 8, wherein the second roller applies a predetermined pressure to the first roller and contacts the first roller so that the second roller rotates together with the first roller.

16. The printer of claim 9, wherein a first elastic deformation between the other end of the support lever and the interference member is larger than a second elastic deformation required for an engagement of the first roller and second roller.

17. The apparatus of claim 8, wherein at least a portion of the second roller is placed above the second guide when the second roller is engaged with the first roller in the first position.

18. A paper delivery apparatus in a printer to selectively change a stacking direction of printed and ejected paper, the paper delivery device comprising:

a first roller;

a second roller;

a first tray to stack the printed and ejected paper; and a second tray to pivot to a first position where the paper is guided by the first and second rollers and stacked in the first tray, and to pivot to a second position where the paper is guided and stacked so that a side of an image of the paper stacked in the second tray is opposite a side of an image of the paper guided to and stacked in the first tray, wherein the second tray comprises:

a support lever to couple to a hinge of the second tray and to pivot on the hinge, wherein the second roller is coupled to one end of the support lever to rotate, and an interference member to interfere with the other end of the support lever when the second tray is pivoted from the first position to the second position, and to pivot the support lever so that the second roller is engaged with the first roller.

* * * * *